US010083597B2

(12) United States Patent
Nowzari

(10) Patent No.: US 10,083,597 B2
(45) Date of Patent: Sep. 25, 2018

(54) HOME EMERGENCY ALERT LIGHT SYSTEM

(71) Applicant: Nader Nowzari, Oakville (CA)

(72) Inventor: Nader Nowzari, Oakville (CA)

( * ) Notice: Subject to any disclaimer, the term of this patent is extended or adjusted under 35 U.S.C. 154(b) by 0 days.

(21) Appl. No.: 15/448,078

(22) Filed: Mar. 2, 2017

(65) Prior Publication Data

US 2017/0221346 A1 Aug. 3, 2017

Related U.S. Application Data

(63) Continuation-in-part of application No. 14/756,340, filed on Aug. 31, 2015.

(51) Int. Cl.

| | |
|---|---|
| ***G08B 1/08*** | (2006.01) |
| ***G08B 25/01*** | (2006.01) |
| ***G08B 25/10*** | (2006.01) |
| ***G07C 9/00*** | (2006.01) |

(52) U.S. Cl.

CPC ..... *G08B 25/016* (2013.01); *G07C 9/00309* (2013.01); *G07C 9/00896* (2013.01); *G08B 25/10* (2013.01); *G07C 2009/0065* (2013.01)

(58) Field of Classification Search

CPC ..... H05B 37/0272; H05B 37/0227; H05B 33/0854; H05B 33/0803; H05B 37/0281; H05B 33/0845; H05B 37/03; H05B 33/0815; H05B 33/0872; H05B 33/0809; H05B 33/089; H05B 33/0842; H05B 37/0218

USPC ..... 340/539.11, 815.4, 815.45, 691.1, 691.4, 340/539.12, 539.14, 539.26

See application file for complete search history.

(56) References Cited

U.S. PATENT DOCUMENTS

| | | | | |
|---|---|---|---|---|
| 5,025,247 | A | 6/1991 | Banks | |
| 6,933,686 | B1 * | 8/2005 | Bishel | G04G 15/006 307/115 |
| 2002/0003712 | A1 * | 1/2002 | Bishel | H04M 11/007 363/15 |
| 2011/0098953 | A1 * | 4/2011 | Jonsson | G01D 4/002 702/62 |
| 2012/0314571 | A1 * | 12/2012 | Forssell | H04W 12/08 370/230 |

* cited by examiner

*Primary Examiner* — Daniel Previl

(57) ABSTRACT

A personally installable home emergency alert system, for alerting aid responders and to guide them to a residence where an individual has suffered a personal incident, and having a bulb having a globe portion containing a plurality of low voltage response lights, a base portion attached to the globe containing a plurality of response circuits and connectable to a domestic conventional power supply and adapted to activate the response lights, fastening means on the base portion whereby it is adapted to be received in a conventional domestic electrical lamp receptacle, and, a radio frequency remote controller adapted to communicate with the response circuits in the base portion operable to activate the low voltage response lights.

13 Claims, 13 Drawing Sheets

HOME EMERGENCY ALERT LIGHT SYSTEM

This application is a Continuation-in-part of application Ser. No. 14/756,340 filed Aug. 31 2015 title PERSONAL INCIDENT ALERT SYSTEM inventor Nader Nowzari, which was based on U.S. Provisional 62/070,769, filed Sep. 5 2014, title PERSONAL INCIDENT ALERT SYSTEM, the priority of which is claimed.

FIELD OF THE INVENTION

The invention relates to personally installable home emergency alert system for alerting responders to an incident of a personal nature requiring assistance, and in particular, directing responders to the residence of the person.

BACKGROUND OF THE INVENTION

Persons, who may be handicapped or partly disabled or simply liable to an accident or a health problem of a personal nature, frequently live in private residences. Often they are alone. If and when a personal incident occurs, in such a private residence, it may be some time before aid responders learn of the incident. In addition, where the incident happens in a personal residence, the responders frequently have difficulty in identifying the particular residence. This is a particular problem where they have a street number requiring illumination.

Such a private residence may have several rooms and floor levels which would be in use by the individual.

This invention is targeted to a partly disabled or handicapped person or simply the elderly or otherwise infirm, who may live alone is such a residence, but it will also include the average individual. For example, if such a person has a fall or a sudden health problem, they may be unable to reach a telephone. If they do reach a telephone it may be difficult to communicate with a 911 service, or a responder.

Numerous communication systems have been proposed and some even marketed, for such handicapped or other persons liable to be subject to such an incident.

However such systems were largely dependent on, for example, remote communication by telephone. In most cases these earlier systems have required installation by a skilled trade's person. Often they required maintenance, or regular checking to ensure operability. Monthly charges were usually payable to a monitoring company. All of this has limited the use of such systems to a small segment of society.

In cases of an incident requiring assistance, the responders must identify the address of the resident and then find the residence as quickly as possible. Usually in the case of private residences, there will be a front porch and at least one lighting receptacle.

An alert light of some kind, on the front porch would greatly assist first responders looking for a particular residence.

One of the principle obstacles to any such alert or alarm system is that in most cases it would require installation by skilled trades. Alterations would be made to the electrical system in the home, at considerable expense. This expense often put them out of the reach of the very persons, i.e. the handicapped or elderly persons, who had the greatest need for them.

Most homes have a porch exterior light on the front, near the front door or by the garage.

Normally the homeowner would switch this porch light on only when a visitor was expected. Otherwise it was switched off in most cases. Ideally any alert light system will make use of the existing porch light fittings, so as to avoid the need for a tradesman. However if the porch light incandescent LED bulb was simply replaced by some form of remotely activated alert light bulb, then the porch light was no longer available for lighting the front door for visitors.

If the alert light system requires main voltage power, then the porch light switch would have to left on day and night. It is therefore desirable to provide personally installable home emergency alert system which can be used in conjunction with the existing porch light fixture on the front of the house, and which provides both for the optional switching on or off of the standard porch light and also provides for supplying power day and night to the alert light system.

Such a system should preferably be available for personal installation, by the resident or a relative, without the need for professional help.

If possible such a system would also provide for communication to first responders, such as fire services, paramedics and possibly police, or even relatives.

All of this should be available as a kit, ready to be personally installed by the purchaser, or a relative, without professional help.

Where possible the system will also provide for a signal to be sent to the responders giving the GPS co-ordinates of the residence. This will still further facilitate the directions to the responders and bring aid quickly to the resident. This can be sent via satellite signals.

The system should also desirably provide a remotely operable door lock. In this way the signal from the remote, which activates the alert light, and which alerts to responders, will also open the lock. In this way the responders can enter the residence without the need for damaging the door.

Ideally it should be operable without reliance on an outside monitoring service, and payment of monthly fees.

BRIEF SUMMARY OF THE INVENTION

The invention provides a personally installable home emergency alert system which when activated can direct aid responders to the residence quickly. In particular the invention provides such a personally installable home emergency alert system device in the form of an electrical alert light bulb, which is capable of fitting into a conventional electrical socket on the exterior of the residence and being powered by the regular electrical power system in the residence through a driver circuit and switches, and a remote activator carried by the resident operable to activate the alert light from within the residence in the event of a personal incident to guide responders to that residence.

Preferably, such an alert light bulb will incorporate circuitry which will enable the bulb to provide a flashing alert signal. The circuitry in the bulb will respond to remote wireless signals, from the remote personal activation device, which may be attached to the resident.

The entire personally installable home emergency alert system may incorporate a master unit within the residence to be connected to a domestic telephone line system already in the residence, and operable to enable the resident to communicate with aid responders.

The alert flashing circuitry is incorporated in the alert bulb itself. This greatly simplifies personal installation and use by the resident. All that is required is for the resident to buy the kit that includes the alert bulb with the circuits incorporated in it, and a remote control which is capable of communicating with the circuitry within the alert bulb. In this way, it is not necessary for the resident to change the wiring or voltage in the residence, or to install any special antenna or communication wiring in the residence. The remote device carried by the resident will communicate directly with the circuitry in the alert bulb, using radio frequencies, in a remote manner.

In a preferred form the personally installable home emergency alert system provides a porch light adapter appliance which can be screwed into the conventional pre-existing porch light fitting on the residence. The adapter will provide sockets for the conventional porch light, and for the alert light.

The remote alert circuits will activate an audible alarm, as well as a visual alert light alarm signal.

The entire system may include a personally installable home emergency alert system master unit for connecting with a regular phone line, or with a cellular phone connection, and which may also be connected through the internet. Such communication could also include relatives of the resident. It should also provide for two way voice connection i.e., a microphone/receiver in the remote to the standard telephone line.

In some cases, the circuits may be incorporated in a separate bulb adapter.

Such a bulb adapter may simply be a typical screw -in bulb base, which can be screwed into the usual domestic bulb socket on the exterior of the residence, and which can incorporate a body containing circuits responding to the remote, and provided with a threaded bulb receptacle for reception of a standard voltage bulb. In this case, the circuits which respond to the radio frequency remote will additionally provide for power at the standard voltage to be provided to a bulb, located in the bulb receptacle.

The adapter may incorporate two conventional bulb sockets. One socket can receive the alert bulb itself. The other socket can receive a regular domestic type bulb.

The internals circuits are responsive to the remote to, for example, switch the domestic bulb on or off as required, while leaving the alert bulb powered at all times.

In a further advantageous feature, the base unit may also incorporate a wireless transmission means, for transmitting a signal to a GPS satellite.

In a further modification the alert signalling bulb itself may be provided with a battery operation, so that it does not require to be connected to a household circuit. The battery may be a typical dry storage alkaline or rechargeable battery, or may be a solar powered battery, accumulating solar energy on a daily basis as required.

In a still further modification the alert light system may be incorporated in a typical illuminated house street number, so that upon activation by the wireless remote, the illumination of the house street number starts to flash on and off. Furthermore such a house street number system may also incorporate a solar battery storage.

Also as an added feature connection with a smoke alarm in the residence will be an added safety feature. The system can also provide a remotely activated door lock, which will respond to an alert signal to unlock the door of the residence.

The various features of novelty which characterize the invention are pointed out with more particularity in the claims annexed to and forming a part of this disclosure.

IN THE DRAWINGS

DESCRIPTION OF A SPECIFIC EMBODIMENT

The invention end product will enable a home owner to place an alert flashing bulb in an exterior socket such as a porch light (10), on the exterior, typically adjacent to the front door of the residence (R.)

The light bulb is designed to receive 220/110 voltage. The light socket typically is supplied with the normal residential voltage, in North America being around 110 volts. The light socket is of the conventional socket design, of the screw threaded type, designed to receive a typical regular domestic light bulb.

Figure 1:
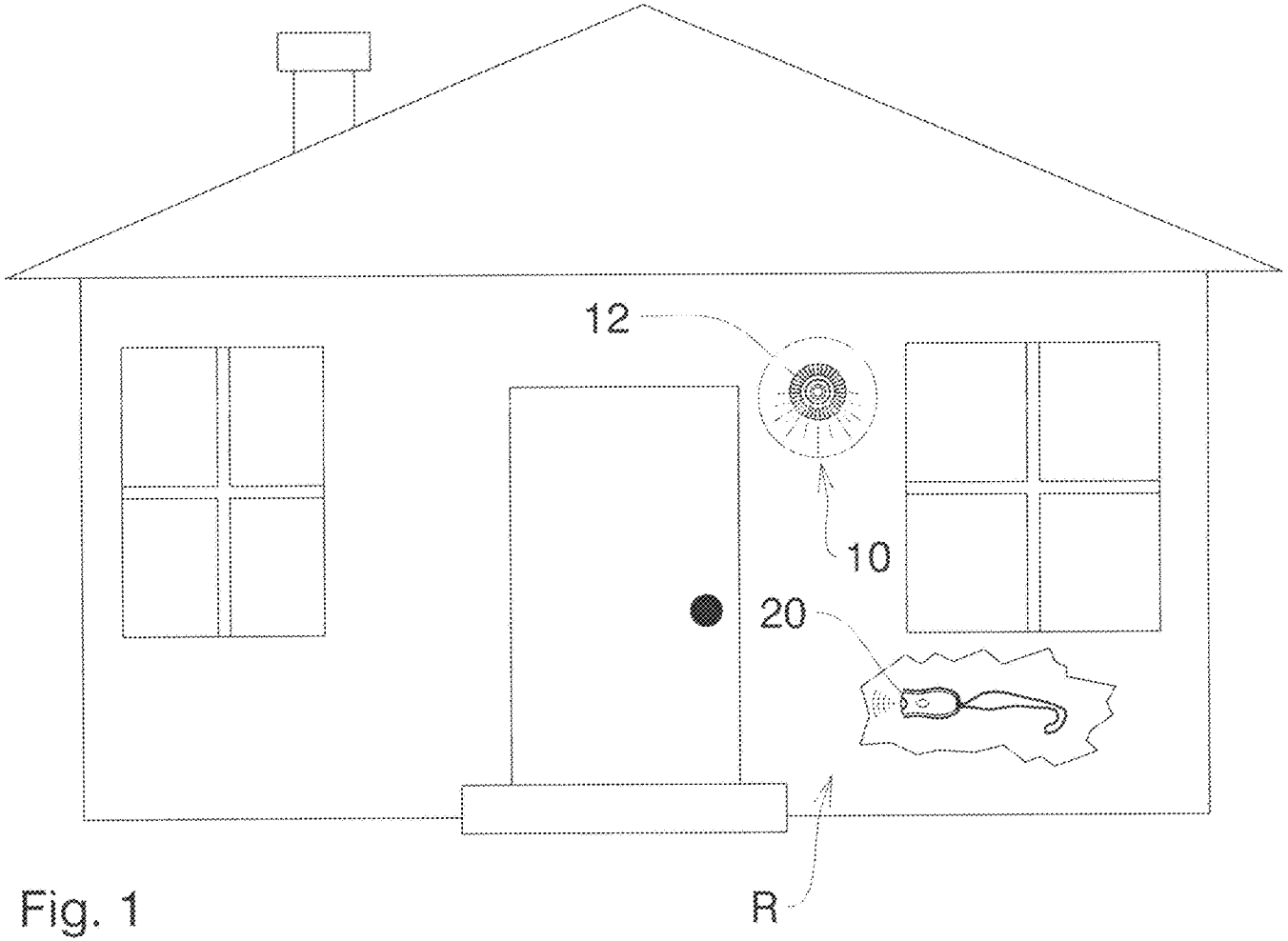
FIG. 1 is a schematic perspective illustration showing a typical residence on a street.
Figure 2:
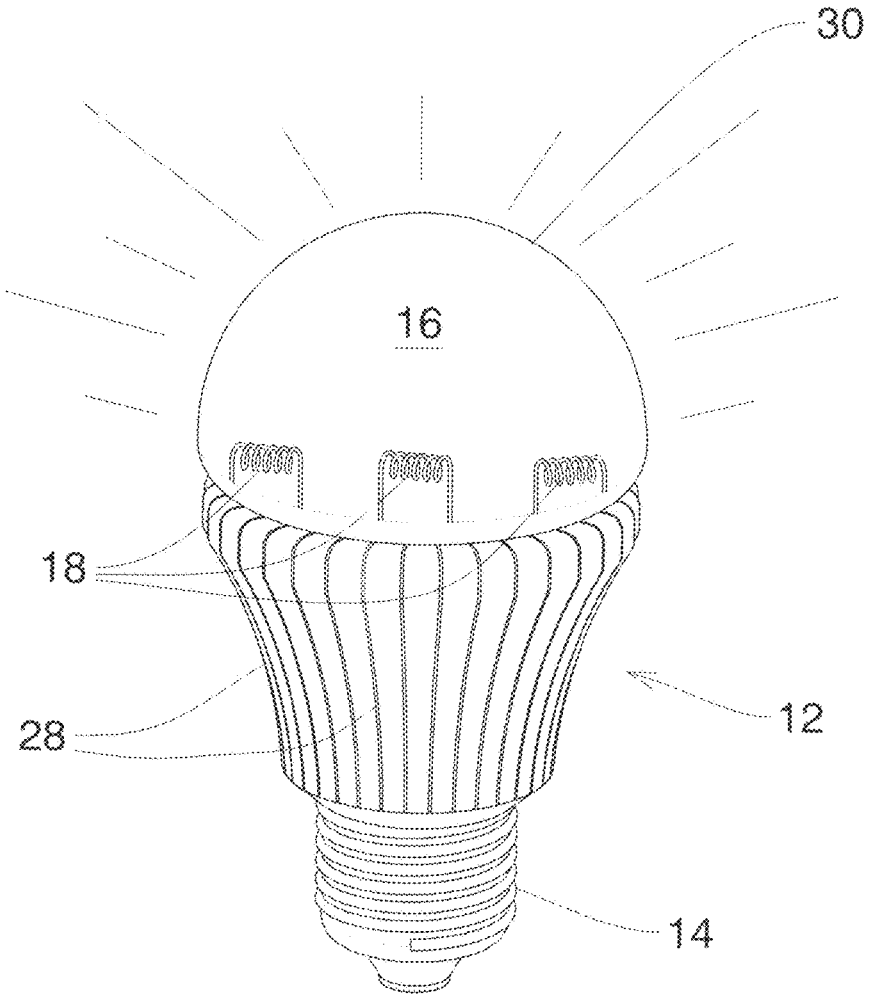
FIG. 2 is a perspective of a bulb incorporating the necessary circuitry.
Figure 3:
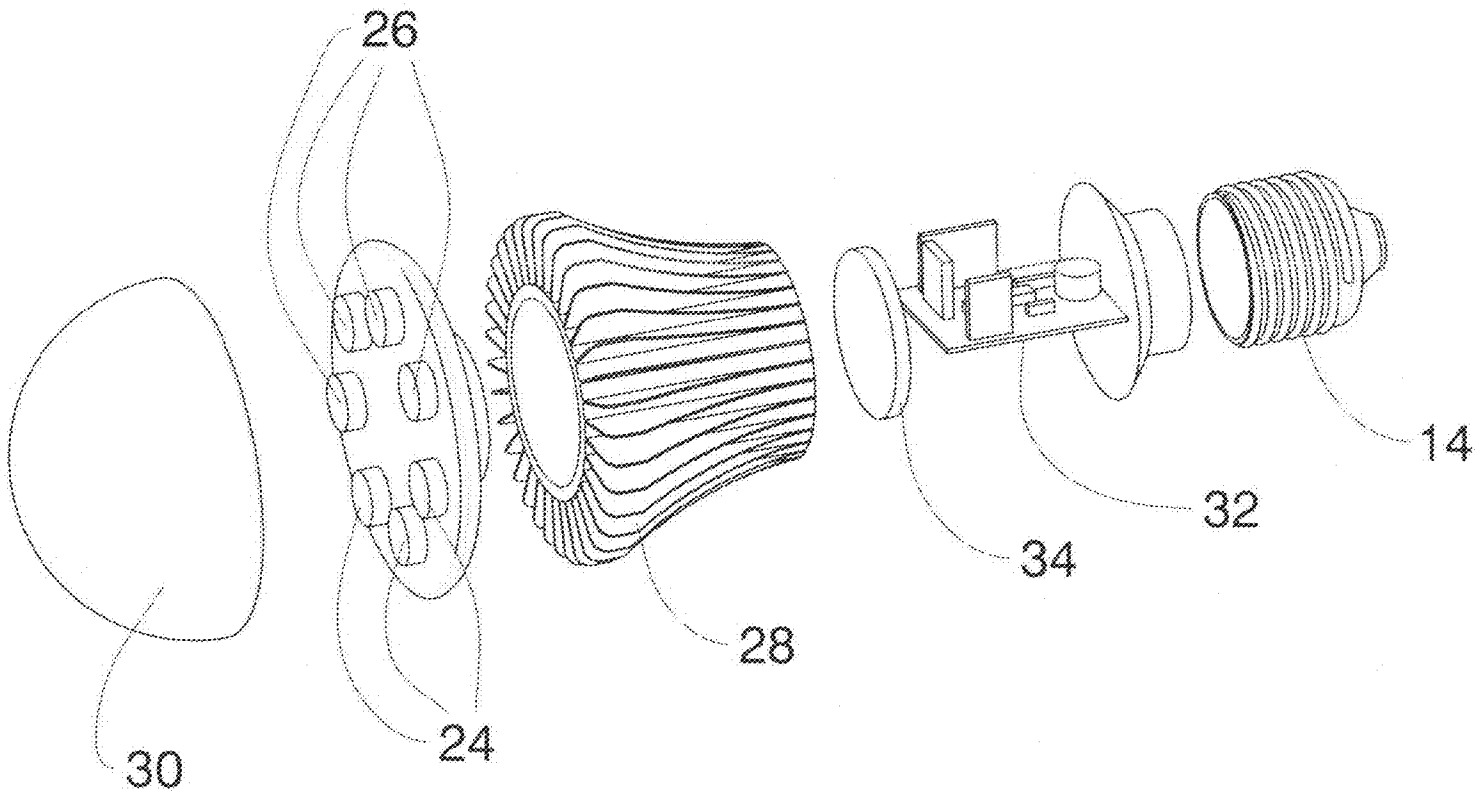
FIG. 3 is an exploded perspective of the bulb and base.
Figure 4:
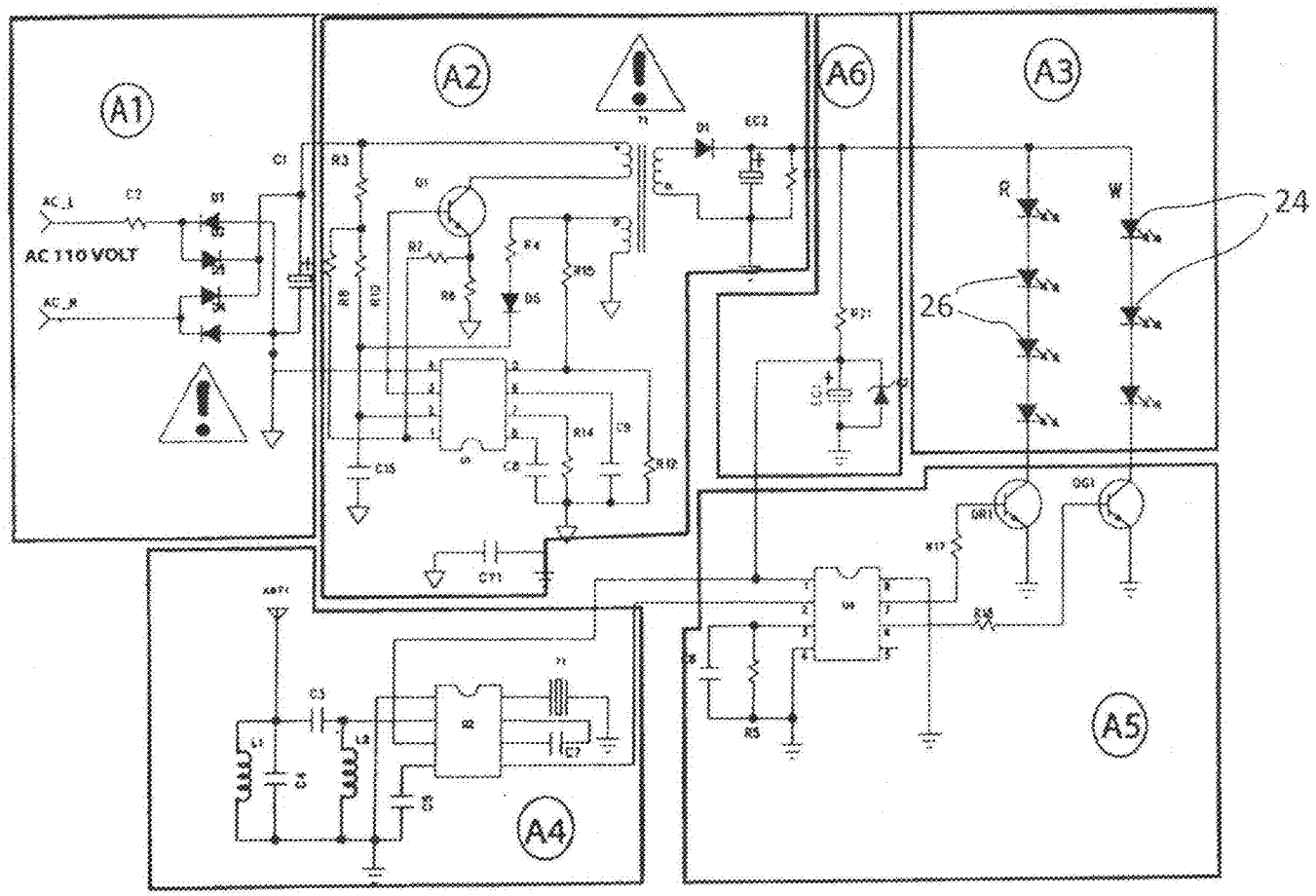
FIG. 4 is a circuit diagram showing the various components of the bulb circuitry.

In order to achieve the objective of the invention, a special alert light bulb (12)is provided (FIG. 3), having an extended base portion (14), and an illumination portion (16) containing special lighting elements (18) for various lighting effects.

The lighting effects may be simply a white light, or may be alternating to a red and white flashing light.

In order for a resident to activate the alert light bulb (12), a suitable remote control (20) is provided. The remote (20) will typically be fitted with a cord which can be worn around the neck.

However other forms of remote are possible, including wrist operation, or a waist band (not shown).

The remote (20) will contain suitable radio frequency circuits such as are well known in the art. Such radio frequency circuits will have a range suitable for transmission throughout the residence, and will be of sufficient strength to reach the control circuits in the bulb itself.

The alert bulb (12) as explained above has suitable circuitry incorporated in the bulb base (14), to carry out two functions.

The first function is of course to receive the domestic voltage of alternating current and convert it to a suitable low voltage, typically around 5 volts, and direct current, so that it is suitable for processing through miniaturized circuits and powering LED lighting elements (18).

The second function is to activate the circuitry in the bulb base (14) responsive to radio frequency signals from the remote, so as to power the LED elements (18) in the bulb (12), and provide a flashing signal.

It will be appreciated that the elements in the bulb (12) are low voltage, e.g. LED units (18) which provide light from low voltage sources. In this case, there are three LEDs (24) which provide white light and four LEDs (26) which provide red light. In this way it is possible to arrange that when it is in emergency use, the alert light will flash alternately red and white, thus providing distinctive and unique guidance identification for recognition by responders.

A heat sink (28) is provided and a dome (30) covers the LED's (24, 26).

Figure 5:
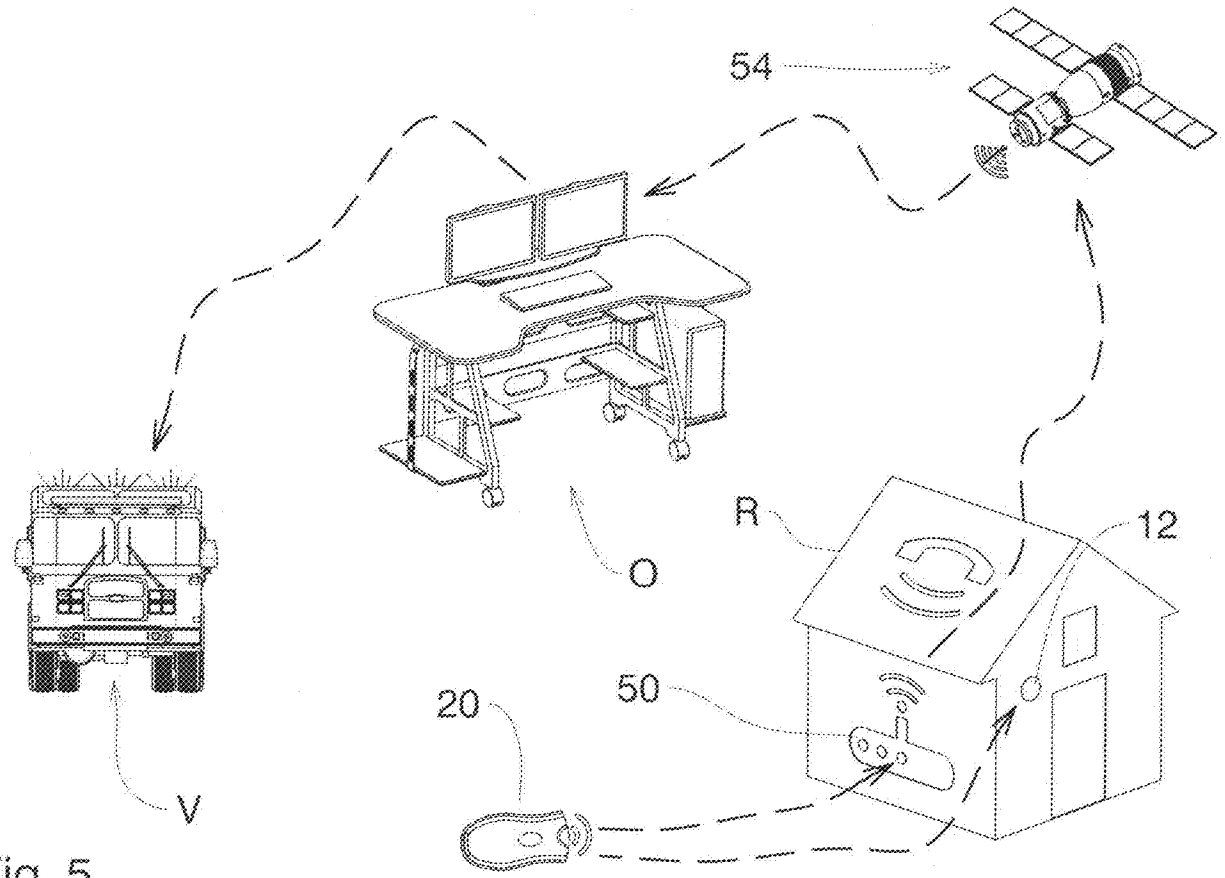
FIG. 5 is a schematic perspective illustration of a use of the system with a GPS satellite.

In order to achieve this, the circuits will be seen to comprise (FIG. 5):

A1, a power supply,

A2, an isolating power supply which converts high voltage DC to low voltage DC current and power the LED lights.

A3 shows the LED lights.

A4 is the radio frequency receiver. These components have an antenna and receive signals from the remote, when it is activated.

A6 is a voltage regulator supplying DC power to the receiver.

A5 is a logic switch which controls the switches, for activating the red and/or white LEDs.

All of these circuit components are mounted on a miniature circuit board (32) contained within the bulb base (14).

Within the base (14) and middle component (28) a siren sound generator (34) may also be provided. Siren (34) is connected to circuit board (32) and suitable switches, on the board.

The bulb base (14) is, as explained above, provided with a typical screw base fitting, such as is well known in the art, to be screwed into a conventional household electrical lighting socket in North America. Other bases such as pin types may be provided for various other designs of sockets.

The remote will require a battery pack to power the radio frequency signals in the event that they are required. The provision of such a remote with a battery pack is well known in the art and requires no special description.

Similar circuits can be provided for incorporation in a telephone alarm system. Such a telephone alarm system will typically incorporate a master unit (50), which is connected to the land line. The master unit (50) will typically incorporate a wireless receiver, for receiving signals from the wireless remote, and may also incorporate a voice system including a microphone, and a speaker (not shown) so that a person may carry on a conversation without actually lifting up a telephone unit. The master unit will be connected simply by a conventional; telephone jack (not shown).

Thus, when remote (20) is activated, the master unit (50) will send a telephone signal to the responder office and the remote also activates the alert bulb (12).

The system can also connect via a cell phone. Such a cell phone connection can be in addition to the bulb and siren. It will provide direct voice connection between the distressed person and a responder.

The system can also be used in conjunction with GPS satellites (54). The master unit (50) would be provided with a transmitter to transmit signals to a satellite. This satellite would in turn retransmit those signals directly to a responder office (O). The responder office could then immediately send GPS location instructions to the responder vehicle (V) which might already be on the road. This will further speed up the arrival of the responder, at the desired location.

Figure 6:
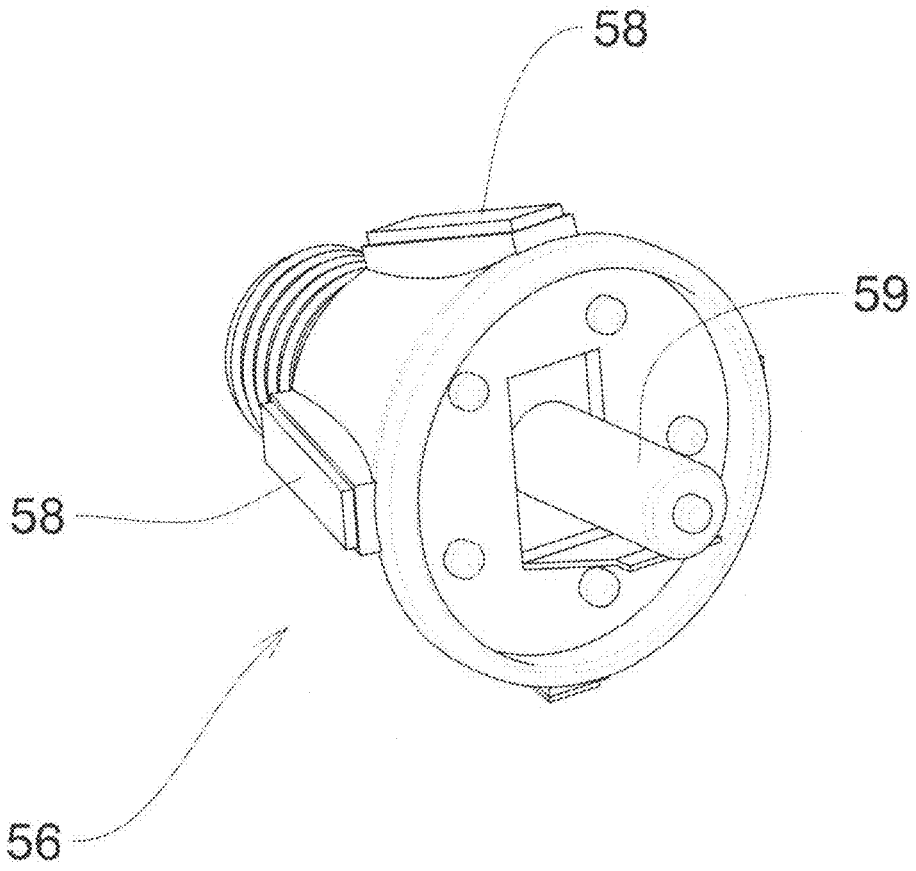
FIG. 6 is a perspective illustration showing a form of alert light incorporating a battery, and solar panels.
Figure 7:
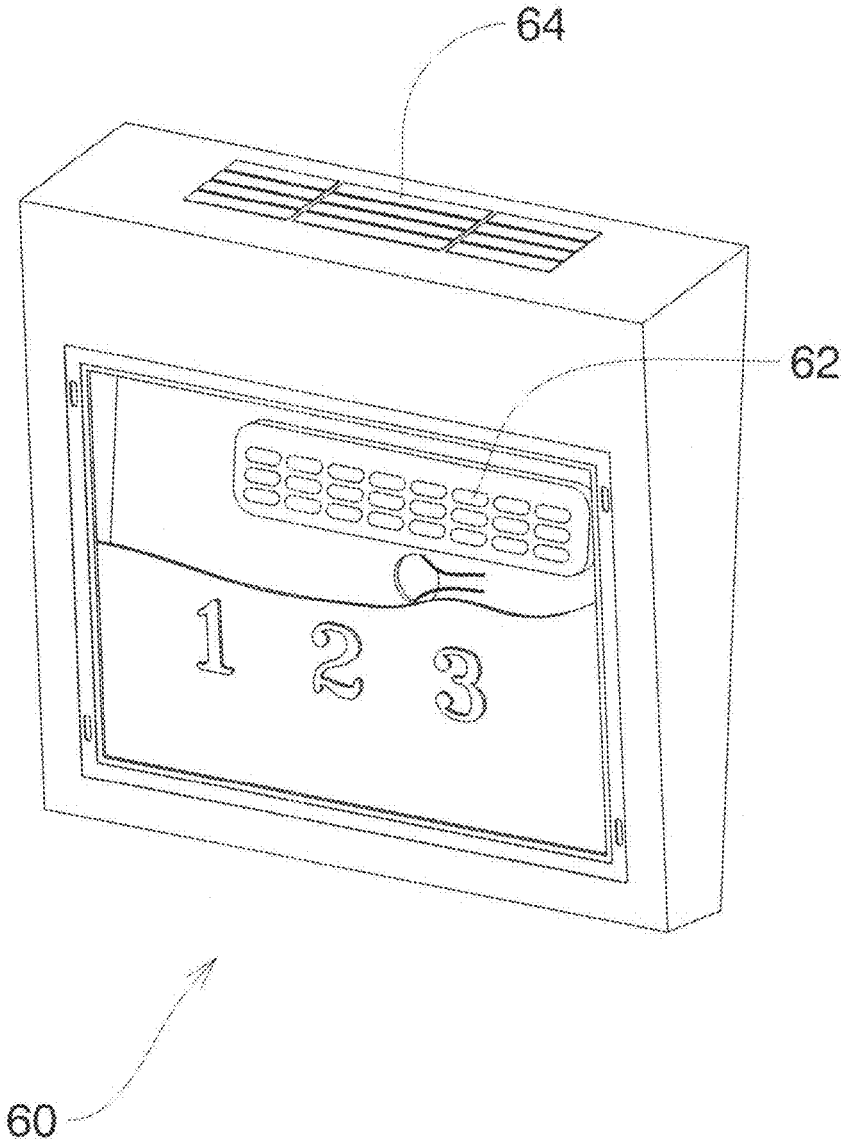
FIG. 7 is a perspective illustration of a typical house street number sign, incorporating an illuminated street number panel, and flashing LED lights.

In some cases a porch light (56) FIG. 6 may be operated by solar panels (58) charging a suitable battery (not shown).

In some cases, houses are provided with illuminated house street number signs (60). In these cases, the house number sign can be modified so as to incorporate LED illumination (62), and may be powered by the domestic power or by solar power through solar panel (64). Thus when activated by the wireless remote (20), the house number can then be illuminated by the flashing LED lights, which may for example change colour.

In a more advanced case, it may be possible for the LED lights to provide a word such as the word help H E L P in place of the house number.

Figure 8:
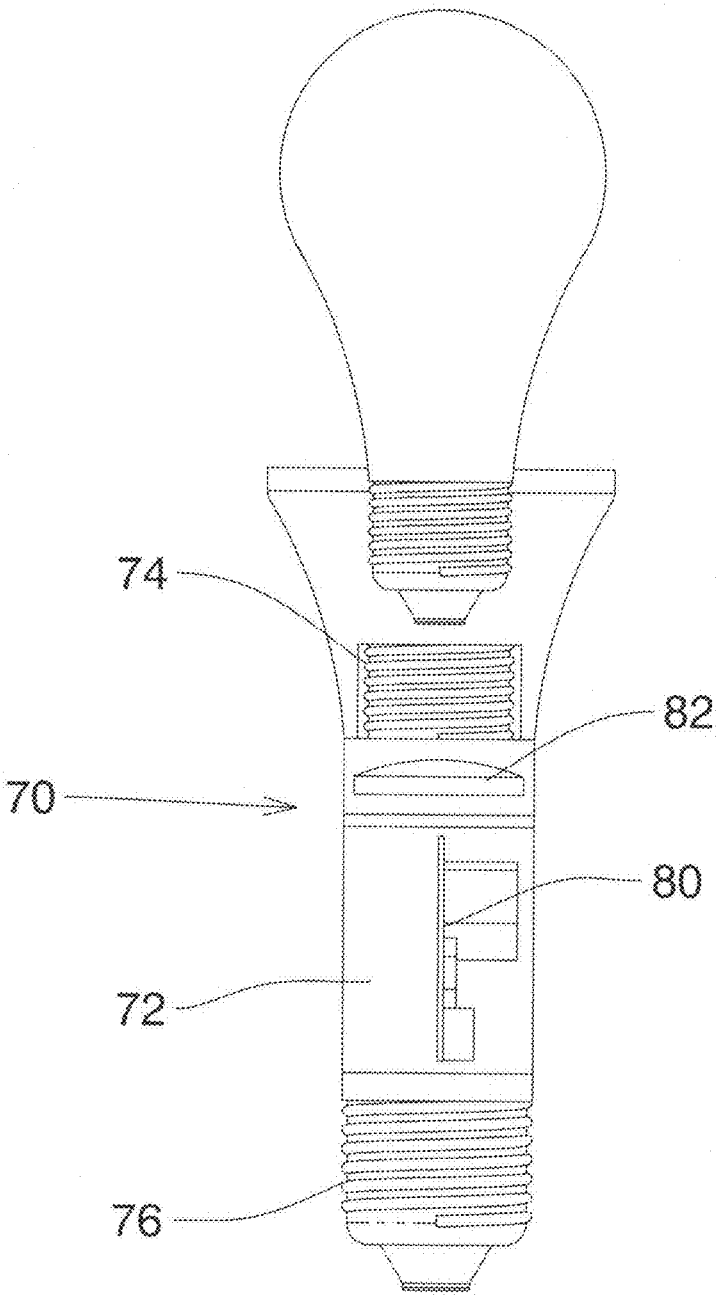
FIG. 8 is a perspective illustration of a bulb socket adapter.

There may be some households who still wish to use a conventional porch illumination. In this case, as shown in FIG. 8, the invention can be incorporated in an adapter (70).

The adapter contains four main parts:

A body (72);

A socket (74) (screw or pin) to receive and hold the alert light bulb either by screwing the bulb or twisting it inside the socket;

An adapter base (76) of screw (or pin) design to be secured in the existing standard (screw in type) porch socket (to convey the power to the driver);

A relay chip board (80) installed within the body (72) of the adapter.

The relay responds in this case to 110 AC volts without reducing the voltage, to supply power to a regular 110 AC volts light bulb.

The relay (80) is an auto ON/OFF switch. The switch will cut off the power every 30 seconds from the alert light bulb.

This action will change a regular household light bulb into a flashing/blinking emergency alert light. The flashing/blinking time can be set to various time frames such as 80 blinks to 200 blinks per minute. The timing depends on how fast or slow is required.

A siren (82) is also installed in the bulb base to generate a sound effect at the time of emergency. When the alert light is activated and starts blinking, the siren will start as well.

There may be some householders where there is a porch light, on the front porch of the house, and an interior switch, by means of which the porch light can be switched on or off.

Figure 9:
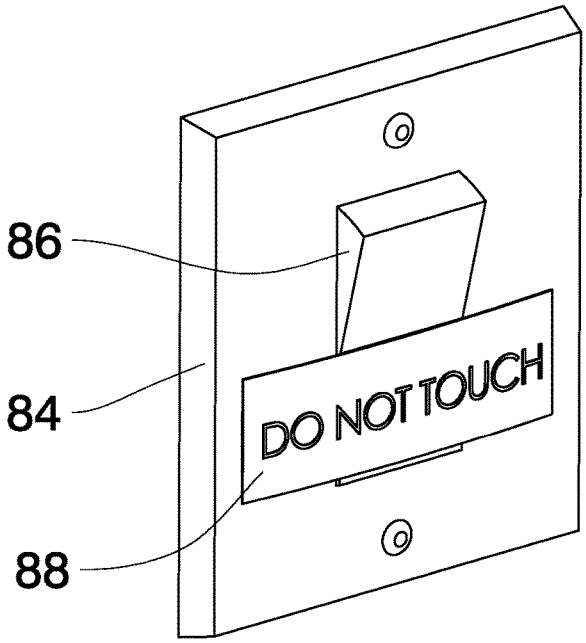
FIG. 9 is a perspective illustration of a porch light switch.

In order to ensure that the alarm system of the invention is available 24 hours a day 7 days a week, the porch light switch should always be left on. In order to assist the resident, FIG. 9 shows a typical switch (84), having a tilt arm (86). In order to hold the tilt arm (86) in the on position, an adhesive label (88) may be provided, acting partly as a reminder and partly as a control of the switch.

Figure 10:
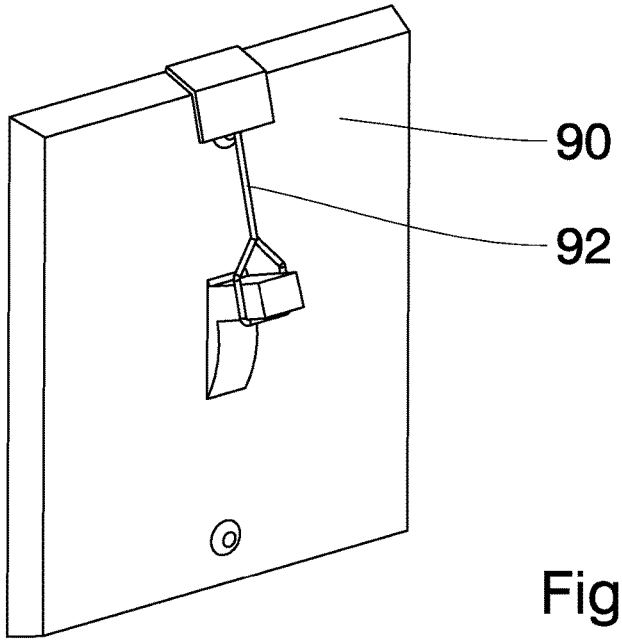
FIG. 10 is a perspective illustration of an alternate form of porch light switch.

In other households, a porch light with the usual toggle switch (90) such as shown in FIG. 10 may be provided. In this case, a toggle switch control (92) may be provided. Such a control (92) as shown in FIG. 10 will have a loop fitting around the toggle (90), and having a clip fitting around the edge of the switch face plate.

It may also be possible to connect a smoke and heat detector (not shown) to the master unit. In this way, if there is a smoke problem detected, an alarm can be sent automatically as well as activating the interior and exterior alerting lights.

Figure 11:
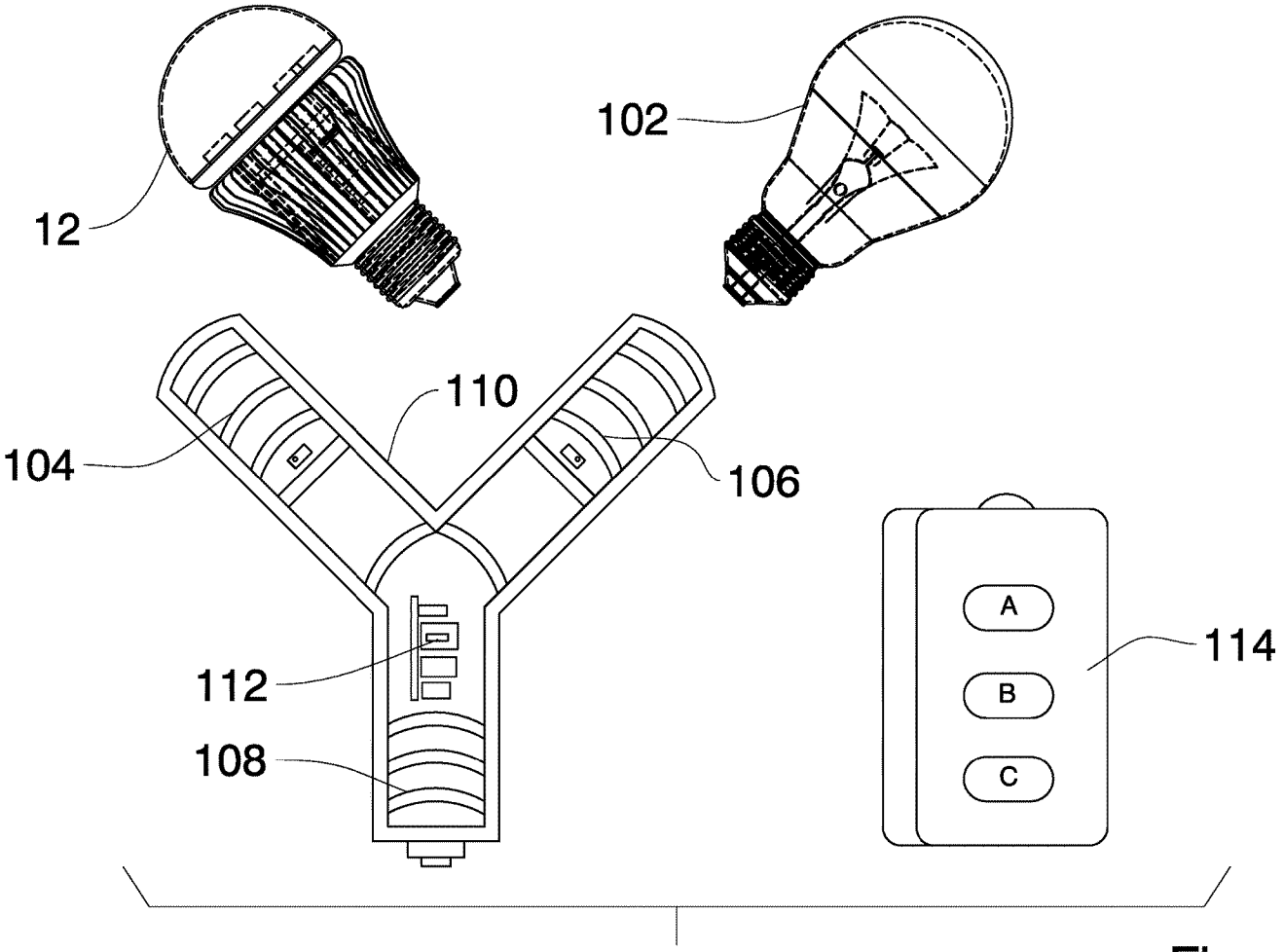
FIG. 11 is a schematic illustration of an adapter for mounting both a conventional incandescent bulb, and also an LED alert flashing bulb.
Figure 13:
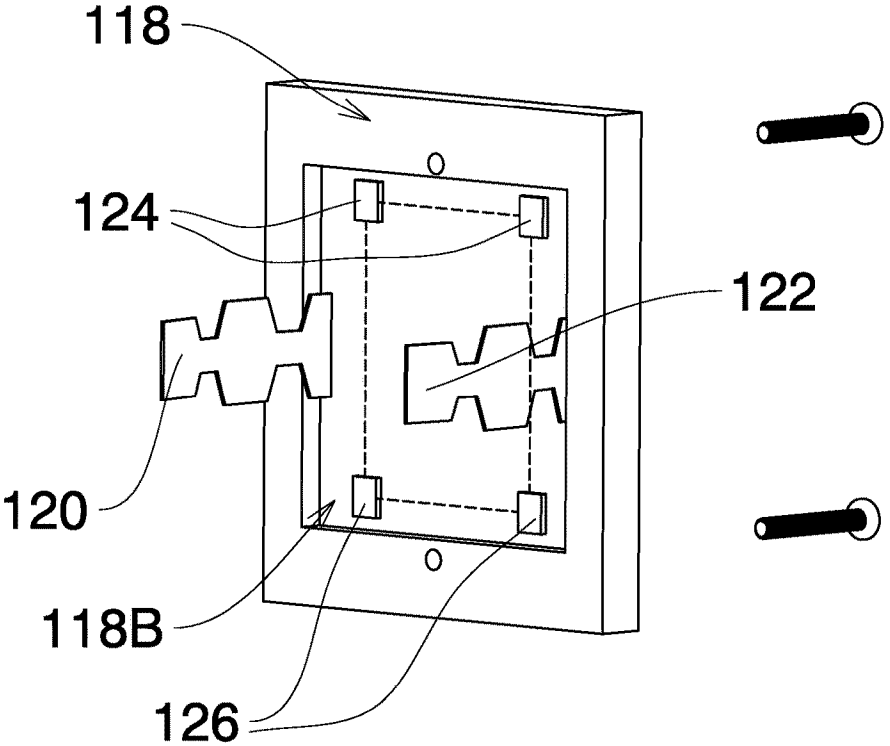
FIG. 13 is a cut away schematic of a wall switch converter.
Figure 12:
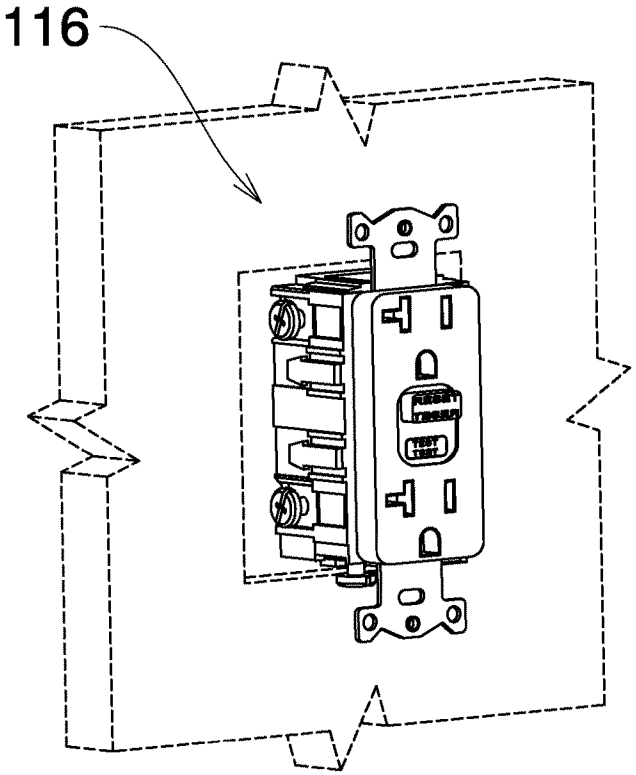
FIG. 12 is an enlarged schematic of an alert bulb.
Figure 14:
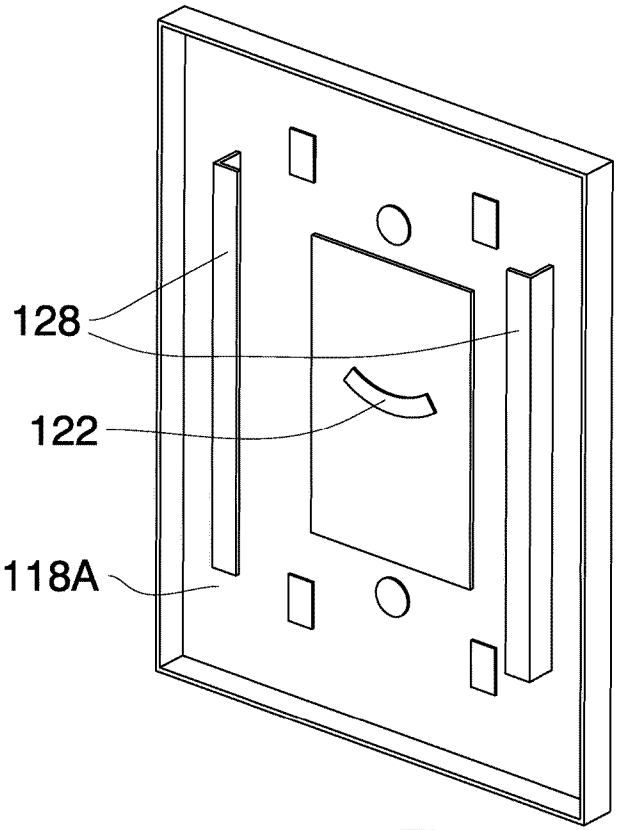
FIG. 14 shows a door lock operated in response to the remote.
Figure 15:
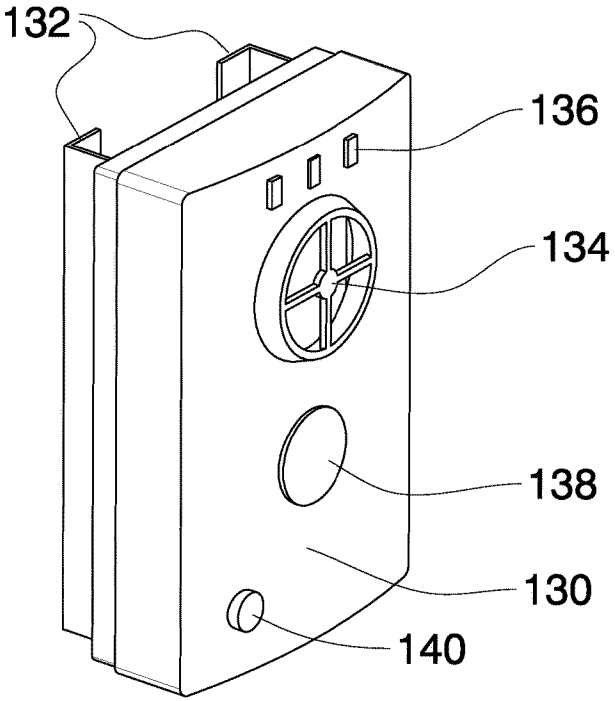
FIG. 15 is a front perspective of the cover plate for the wall switch.

In a further embodiment the invention provides a three way porch light adapter (100), (FIG. 11) for carrying both the alert light (12) and also a regular domestic light bulb (102).

The adapter (100) has an alert light socket (104), for receiving the alert light bulb (12).

The adapter (100) has a regular bulb socket (106) for receiving a regular bulb (102).

The adapter (100) has a screw in type base (108). All three components are housed in a single moulded housing (110) in the shape of a letter Y. Within the housing there is a switch circuit (112). The switch circuit (112) is operable to provide uninterrupted supply of domestic voltage to the alert bulb socket (104).

The switch circuit (112) is also operable to receive on/off commands from the remote (114) to enable the resident within the residence to operate the regular bulb (102) for illumination of the porch on the exterior of the residence as and when a visitor is expected. At other times the domestic bulb can be simply switched off, from the remote.

The power to the alert bulb socket (104) will however remain uninterrupted, regardless of whether the domestic bulb (102) is on or off.

For this embodiment the remote (114) will have three switches (A), (B), and (C).

Switch (C) will operate the domestic bulb (102), on or off.

Switch (A) will switch the alert bulb on, to indicate the location of the residence where there is a personal incident, and will also activate the siren (not shown), and the master unit (not shown) within the residence.

As and when responders arrive at the scene switch (B) enables the alert system to be switched off.

As a further feature the invention provides a modification for use on the internal domestic porch light switch (116).

For this purpose the wall switch (116) is shown, exposed, with its usual cover plate removed.

A personally installable contact plate (118) is provided having front and rear faces (118 A) and (118 B).

On the rear face (118 B) there are two spring metal contact arms (120) and (122). The arms are located on opposite sides so as to contact the usual domestic power terminals on opposite sides of the switch (116).

On the front face (118A) of contact plate (118) there are two upper contacts recesses (124) and two lower contact recesses (126.) These recesses contain interior electrical contacts (not shown), which carry power from the two arms (120) and (122).

Plate (118) is attached to switch (116) by conventional screws passing through openings in the plate.

Plate (118) has two channel strips (128), attached to the front face (118 A), and extending parallel down opposite sides of the front face (118 A).

A personally installable exterior cover body (130) is attachable to the contact plate (118), by a pair of L-shaped edge flanges (132), which are intergageable with the channel strips (128).

Body (130) contains a siren (134), if desired, and a speaker/receiver (136) for voice communication.

A panic switch (138) can also be provided, operable to activate the whole system, if the remote is unavailable to the resident.

An indicator light (140) is also provided which shows that the entire system is live and powered.

Figure 16:
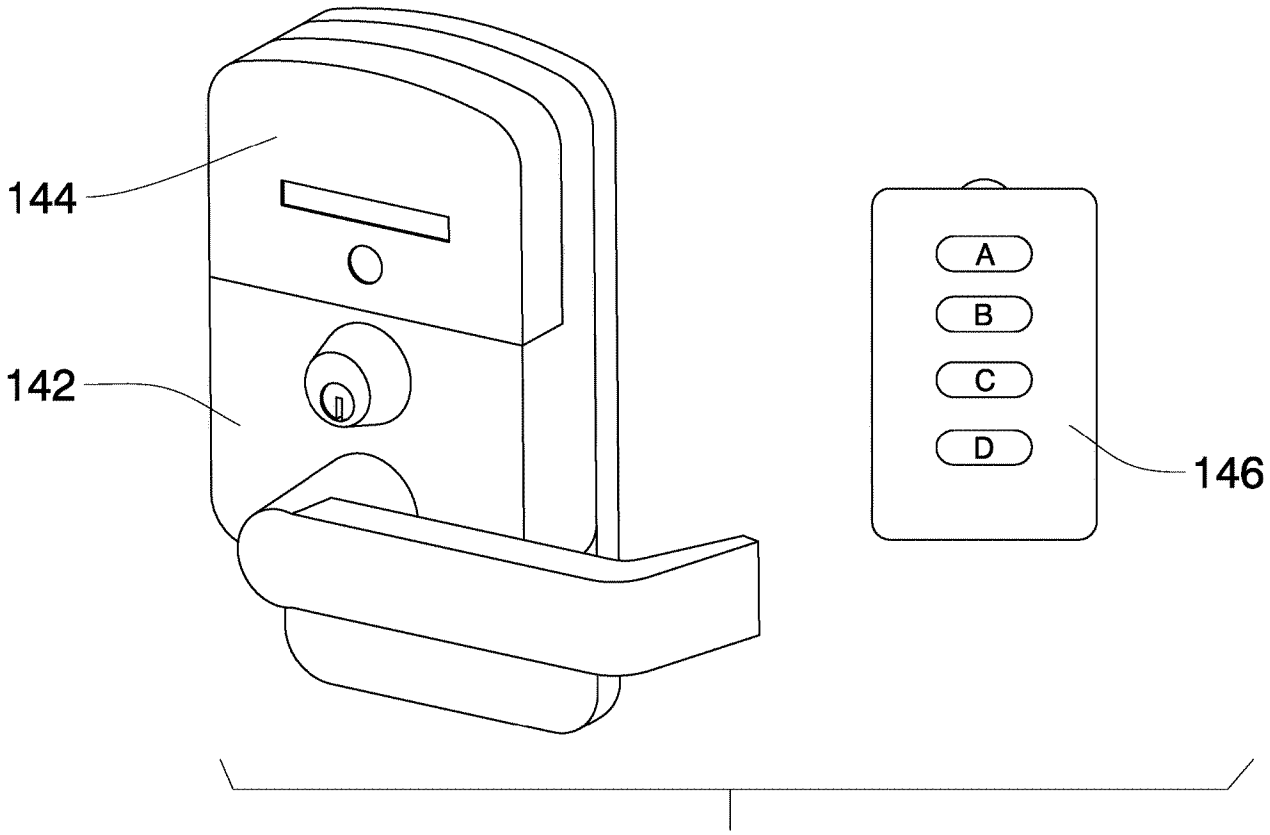
FIG. 16 shows a remotely operated door lock and a remote.

A further option is shown in FIG. 16. In this embodiment a remote is provided, which consists of 4 buttons. (A), (B), (C) work the same way as described previously and button (D) will unlock the door. In this case there is provided a personally installable remotely operable door lock (142) for the residence. The lock (142) has a wireless responsive lock operator (144), operable in response to activation of said remote to open the door lock and admit aid responders to the residence.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A personally installable alert system, adapted to be installed in a residence and located on the exterior of the residence in a conventional domestic exterior light receptacle and operable to alert aid responders and to guide said aid responders to the residence where an individual within the residence has suffered a personal incident, and comprising;

an alert bulb having a globe portion containing a plurality of low voltage response lights;

a bulb base portion attached to the globe and personally installable and connectable to said conventional domestic light receptacle;

wireless response circuits contained in said bulb base portion and operable to supply low voltage power to said low voltage response lights to activate said response lights upon receipt of a wireless signal from a remote within the residence;

a personally installable fastening means on the bulb base portion for installing the bulb base in said conventional domestic exterior electrical lamp receptacle and receive domestic power;

a radio frequency remote activator personally operable in the event of a personal incident to an individual within the residence to communicate from within the residence with said response circuits in said bulb base portion on the exterior of the residence and activate said low voltage response fights in said alert bulb on the exterior of said residence to direct aid responders to said residence and including an installable door lock having a wireless responsive circuit operable to open the lock, upon receipt of an activation signal from said remote.

2. The personally installable alert system as claimed in claim 1 and including an audible sound device in said bulb base powered by said response circuits and operable to emit a sound when said response lights are activated by said remote from within the residence.

3. The personally installable alert system as claimed in claim 2 and including a heat sink, extending between said bulb base and said globe of said alert bulb.

4. The personally installable alert system as claimed in claim 3 including a personally installable telephone lard line master unit in said residence operable in responsive to activation of said remote to connect with a telephone land line system, and personally installable and connectable to an aid responder, to provide verbal communication, response to activation of said remote.

5. The personally installable alert system as claimed in claim 4 and including a radio signal transmitter in said master unit, responsive to activation of said alert response lights by said remote, to send a radio signal to a satellite.

6. The personally installable alert system as claimed in claim 4 and including a smoke detector in the residence, and a wireless connection between the smoke detector and said master unit operable to send an alarm signal to said master unit in the event of the detection of smoke in said residence.

7. The personally installable alert system as claimed in claim 1 wherein said alert bulb incorporates a rechargeable electrical storage battery, and solar power panels, adapted to respond to solar energy, and recharge said battery, and said battery in turn supplying power to said response circuits.

8. The personally installable alert system as claimed in claim 7 including a porch light unit personally installable and attachable to the exterior of said residence, said porch light incorporating low voltage response lights, and solar panels for powering said response lights.

9. The personally installable alert system as claimed in claim 1 including a personally installable adapter having an adapter base personally installable it said domestic lighting socket on the exterior of said residence, and having a body portion supporting said response circuits, and having a lighting socket member, to receive a domestic bulb and an alert socket member to receive said alert bulb.

10. The personally installable alert system as claimed in claim 9 and incorporating a personally installable switch control, for controlling an interior domestic porch light switch, whereby to prevent disconnecting of power to said porch light receptacle.

11. The personally installable alert system as claimed in claim 9 and including a personally installable integral adapter housing supporting said domestic bulb socket, and said alert bulb socket, and an adapter base screw in portion personally installable in a conventional exterior bulb socket and containing said wireless response circuits.

12. The personally installable alert system as claimed in claim 11 wherein said wireless response circuits are contained in said integral housing and supply low voltage power to said alert light socket, and domestic voltage power to said domestic bulb socket, and being responsive to said remote to switch power on or off to said domestic bulb socket, without affecting power supply to said alert bulb socket.

13. The personally installable alert system as claimed in claim 1 wherein said conventional exterior domestic light receptacle is connected to a switch with conventional domestic power connections thereon, inside the residence and including a personally installable connector plate secured to said switch and to receive domestic power from said power connections on said switch, and a personally installable cover body attachable to said connector plate, and receiving power from said connector plate and a siren and a speaker receiver system for communication with aid responders, and a panic switch operable to activate the system, if the remote is not available, response circuit in said body.

* * * * *